US008043024B2

(12) United States Patent
Lamore

(10) Patent No.: US 8,043,024 B2
(45) Date of Patent: Oct. 25, 2011

(54) PIVOT SWIVEL CABLE BARRIER

(76) Inventor: Michael John Lamore, Greensboro, NC (US)

( * ) Notice: Subject to any disclaimer, the term of this patent is extended or adjusted under 35 U.S.C. 154(b) by 0 days.

(21) Appl. No.: 12/029,479

(22) Filed: Feb. 12, 2008

(65) Prior Publication Data

US 2009/0202296 A1 Aug. 13, 2009

(51) Int. Cl.
*E01F 13/00* (2006.01)

(52) U.S. Cl. ..... 404/6; 49/9

(58) Field of Classification Search ..... 404/6; 49/9
See application file for complete search history.

(56) References Cited

U.S. PATENT DOCUMENTS

| | | | | |
|---|---|---|---|---|
| 1,848,516 | A * | 3/1932 | Davison | 49/9 |
| 4,502,812 | A * | 3/1985 | Zucker | 404/6 |
| 4,567,851 | A * | 2/1986 | Larsen | 119/524 |
| 4,576,507 | A * | 3/1986 | Terio | 404/6 |
| 4,780,020 | A * | 10/1988 | Terio | 404/6 |
| 4,844,653 | A * | 7/1989 | Dickinson | 404/6 |
| 4,989,835 | A * | 2/1991 | Hirsh | 256/13.1 |
| 5,459,963 | A * | 10/1995 | Alexander | 49/34 |
| 6,382,869 | B1 | 5/2002 | Dickinson | |
| 6,845,589 | B1 * | 1/2005 | Thompson et al. | 49/49 |
| 6,857,227 | B2 * | 2/2005 | Russell | 49/49 |
| 6,997,036 | B2 * | 2/2006 | Kojima et al. | 73/12.09 |
| 7,140,802 | B2 * | 11/2006 | Lamore | 404/6 |
| 7,210,873 | B2 * | 5/2007 | Gelfand | 404/6 |
| 2002/0182007 | A1 * | 12/2002 | Yodock et al. | 404/6 |

* cited by examiner

*Primary Examiner* — Thomas Will
*Assistant Examiner* — Abigail A Risic
(74) *Attorney, Agent, or Firm* — Summa, Additon & Ashe, P.A.

(57) ABSTRACT

A light weight, high strength cable supported by a longitudinal device that is capable of stopping a 15,000 lb vehicle at speeds exceeding 30 mph and provides for manual operation by one (1) person, whereas the barrier may pivot, move vertically, or swivel horizontally to control vehicle passage. Typically, the cable is embedded within a longitudinal support device and remains concealed. During normal operations where the vehicle barrier is moved, there is no tension on the cable and it remains unfastened. If a vehicle impact occurs, the cable immediately engages and fastens to the end support structures to resist vehicle impact forces. The light weight cable and longitudinal support device provides span distances exceeding 24 feet across a vehicle travel path, while requiring only one (1) person to manually move the barrier. The light weight cable and longitudinal support device also minimizes the counterweight size. The barrier may be moved by an operator from either side of the vehicle travel path. Both fixed and unfixed end support structures may be utilized. Non-rotating energy absorbing compression springs may be utilized to enhance the vehicle stopping capability.

26 Claims, 12 Drawing Sheets

PIVOT SWIVEL CABLE BARRIER

BACKGROUND OF THE INVENTION

1. Field of the Invention

The present invention is related to vehicle barriers, and more particularly, a cable barrier attached to a longitudinal support device that pivots, moves vertically, or swivels horizontally to selectively move the cable barrier to allow or deny vehicle passage.

2. Description of Related Art

There is much utility in this invention comprising a light weight, high strength longitudinally supported cable which can be readily moved by one person manually to control vehicle passage across a vehicle travel path. It is capable of stopping 15,000 pound vehicles at impact speeds exceeding 30 mph, while providing the capability to attach to fixed or unfixed end support structures which can be readily relocated. Of the prior art, vehicle barriers capable of stopping a vehicle at 50 mph and selectively controlling vehicle passage include sliding steel gates, steel plate wedges, bollards, net systems, and steel bars. Operating vehicle barriers of the prior art, typically requires substantial electric power supply, and certain motors, drives, hydraulic components, cylinders, and actuators. The barriers of the prior art are not operated manually by one person, without significant limitations. The heavy weight of certain system components is a limitation that makes manual operations difficult, especially with longer distances or span lengths across a vehicle travel path. Of the prior art, system installation typically requires excavation and foundation systems installed near the vehicle travel path area, which results in downtime of the vehicle travel path. The weight of certain system components often limits the cycle time, or the ability to quickly raise and lower the barrier multiple times per minute. Large concrete foundations are typically required. Vehicle barrier systems of the prior art are not easily relocated, without significant disassembly and reassembly, or construction of new foundations. System components are not modular, nor allow flexibility in utilizing a multitude of end support structures.

In one method of related art, a continuous solid steel bar with a 3"×6" cross sectional area is used to stop a vehicle. The solid steel bar barrier is raised and lowered across a travel path, and the bar is rigidly fixed against the end support structure on the non-pivoting side when lowered into the down position to stop vehicles. The massive weight of the steel bar significantly limits its ability to span longer distances across a travel path, and still allow for manual raising and lowering. Even span distances of 10 become difficult to manually operate by one (1) person. Massive fixed concrete foundations embedded into the subsurface are required to anchor the end support structures to withstand forces from a vehicle impact. The system cannot be readily relocated, without first constructing new foundation systems.

In another method of related art, a net is raised and lowered across a travel path to stop vehicles. The net is comprised of vertical cables spaced at about 18" apart which are connected to multiple horizontal cable members spaced at about 12 inches apart. Ends of the horizontal cables at each side of the net remain attached and connected the end support structure during normal operations, when the net is raised and lowered. The horizontal cables remain in tension when deployed into the up position. End support structures are embedded in massive concrete foundations to withstand vehicle impact forces, and the barrier system cannot be relocated without disassembly, reassembly, and installing new foundation systems. Electric power, motors, and cylinders, ball screws, or other actuators are required to raise and lower the net, and to operate system components. Some net based vehicle barriers require hydraulic systems which include hydraulic pumps, motors, accumulators, valves, cylinders, pistons, and other hydraulic components. To allow vehicle passage, the net is lowered onto the surface or into a subsurface housing device, and vehicles must drive over top.

BRIEF SUMMARY OF THE INVENTION

The invention addresses the above needs and achieves other advantages while providing a vehicle barrier system capable of stopping a 15,000 lb vehicle at impact speeds exceeding 30 mph. An objective of this invention is to achieve span distances of 24 feet or more across a vehicle travel path, while requiring only one (1) person to manually move the barrier to allow or deny vehicle passage. By utilizing a light weight and high strength cable and attaching it to a light weight longitudinal support device, the pivot swivel cable barrier can achieve span distances of 24 feet or more and still be operated manually. Another objective of this invention is to provide the capability to move the longitudinal support device and cable barrier in multiple directions across the vehicle travel path. The longitudinal support device and cable barrier may pivot, move vertically or swivel horizontally in either a clockwise or counterclockwise direction. Another objective of this invention is to provide the capability to stop vehicles, without requiring subsurface concrete foundations or other subsurface anchoring systems. The pivot swivel cable barrier may utilize different types of heavy end support structures that are not embedded into subsurface foundations, and may slide or move upon a vehicle impact. Another objective of this invention is to provide capability to move the longitudinal support device and cable barrier from either side of the vehicle travel path to allow vehicle passage. Another objective of this invention is to provide a vehicle barrier system with the capability to be readily relocated, without having to disassemble and reassemble system components or install new foundation systems. Another objective of this invention is to provide modular system components that can be easily shipped and field assembled using basic hand tools. Another objective of this invention is to provide the capability to install electric or hydraulic systems, so that the cable barrier may be moved automatically. Another objective of this invention is to provide the capability to install fixed end support structures, where the end support structures do not move during a vehicle impact. The fixed end support structures may include energy absorbing compression springs. Another objective of this invention is to provide an all weather use vehicle barrier system that is not hindered by rain, snow, ice, wind, or other weather conditions. As such, the vehicle barrier system of the present invention provides many advantages while controlling vehicle passage, and protecting against terrorist activities, including truck loaded bombs.

BRIEF DESCRIPTION OF SEVERAL VIEWS OF THE DRAWINGS

Figure 1:
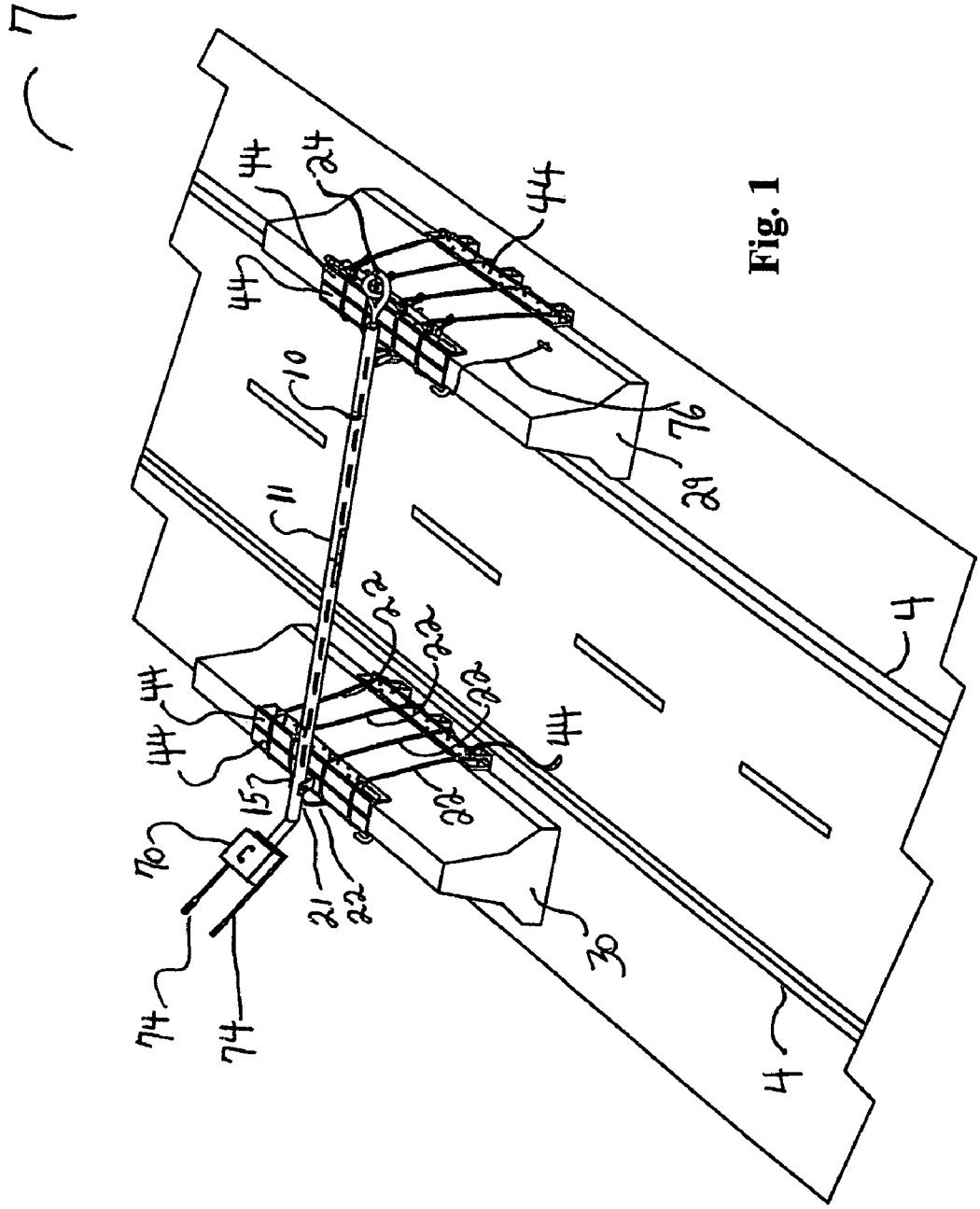
Figure 2:
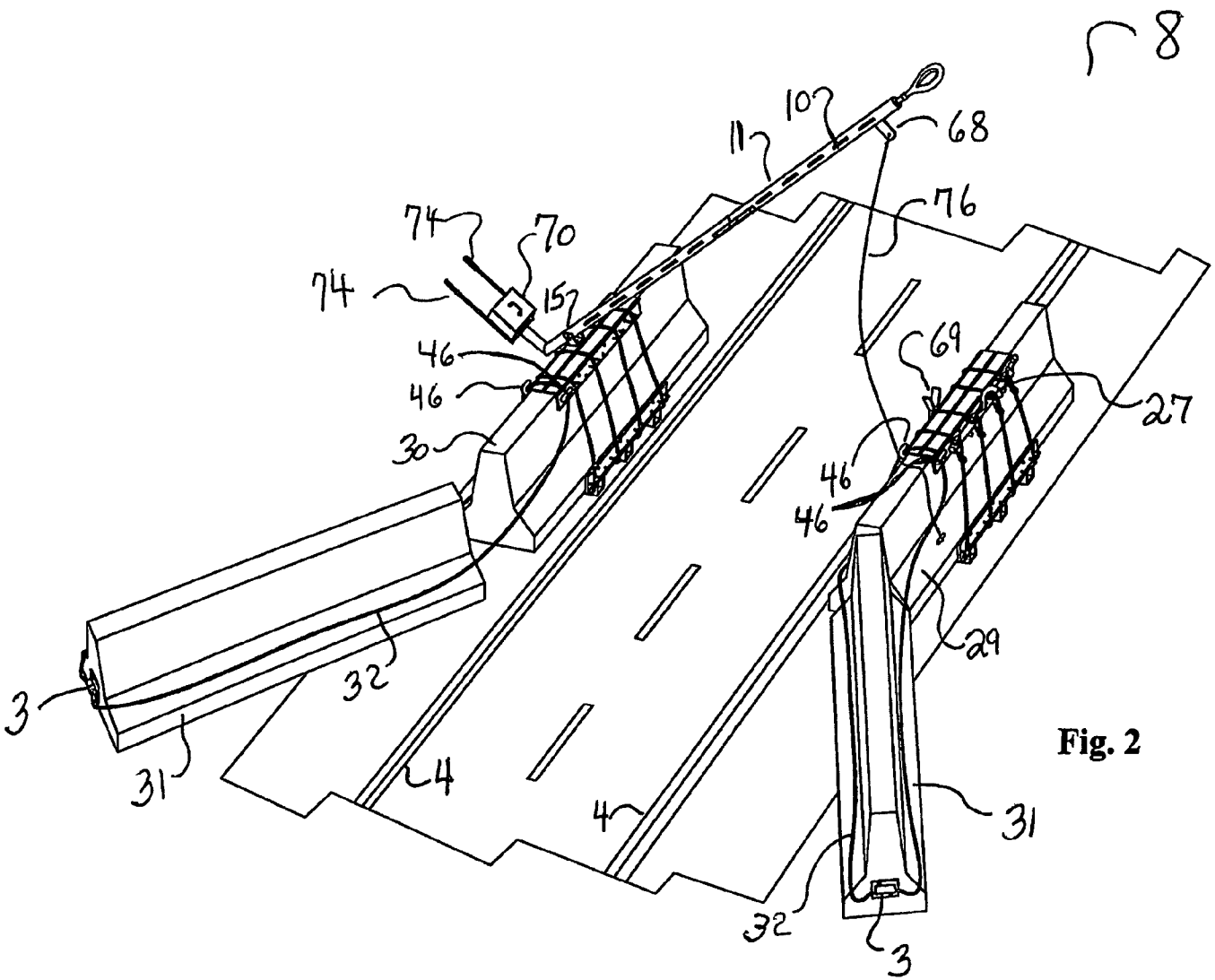
Figure 3:
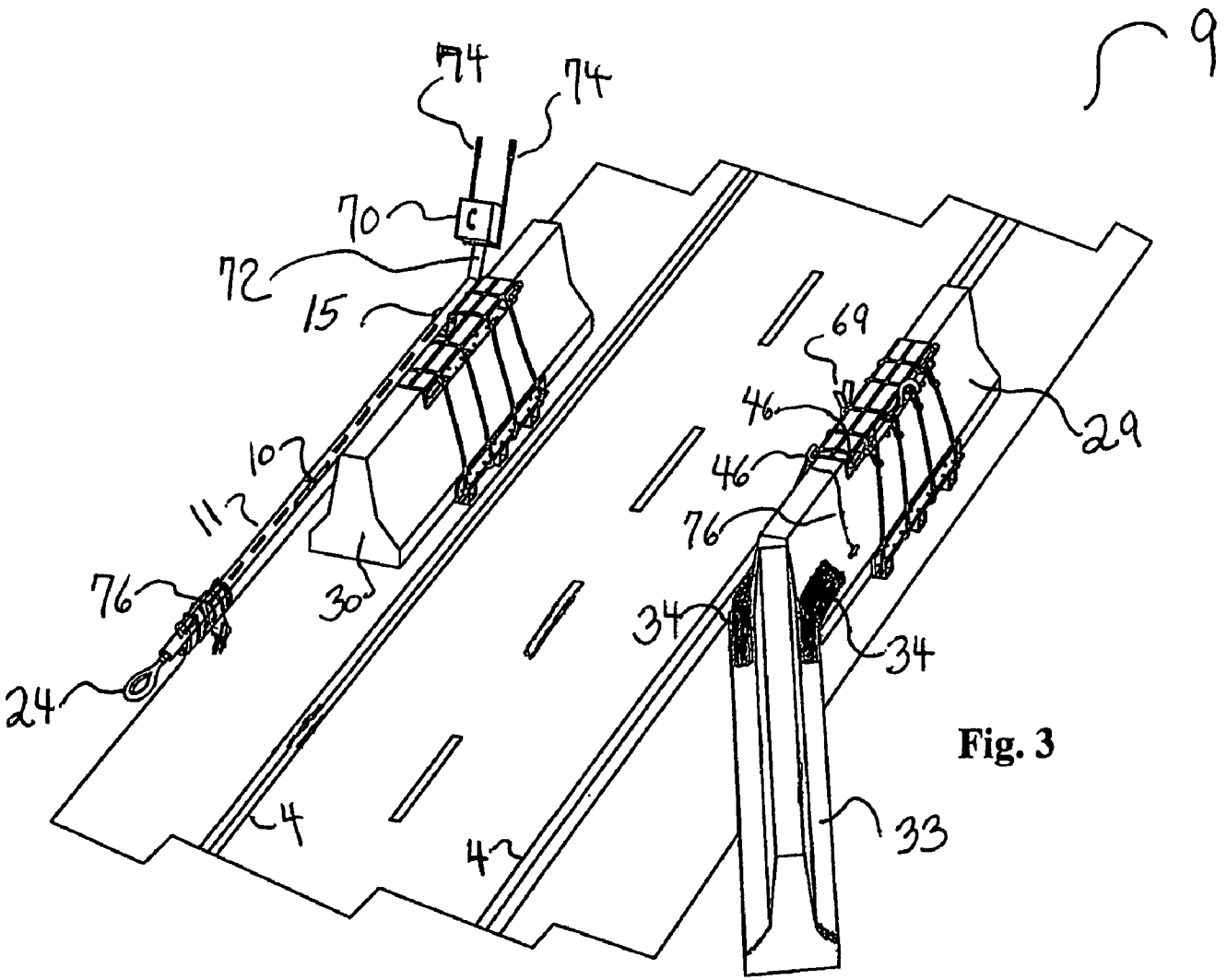
Figure 4:
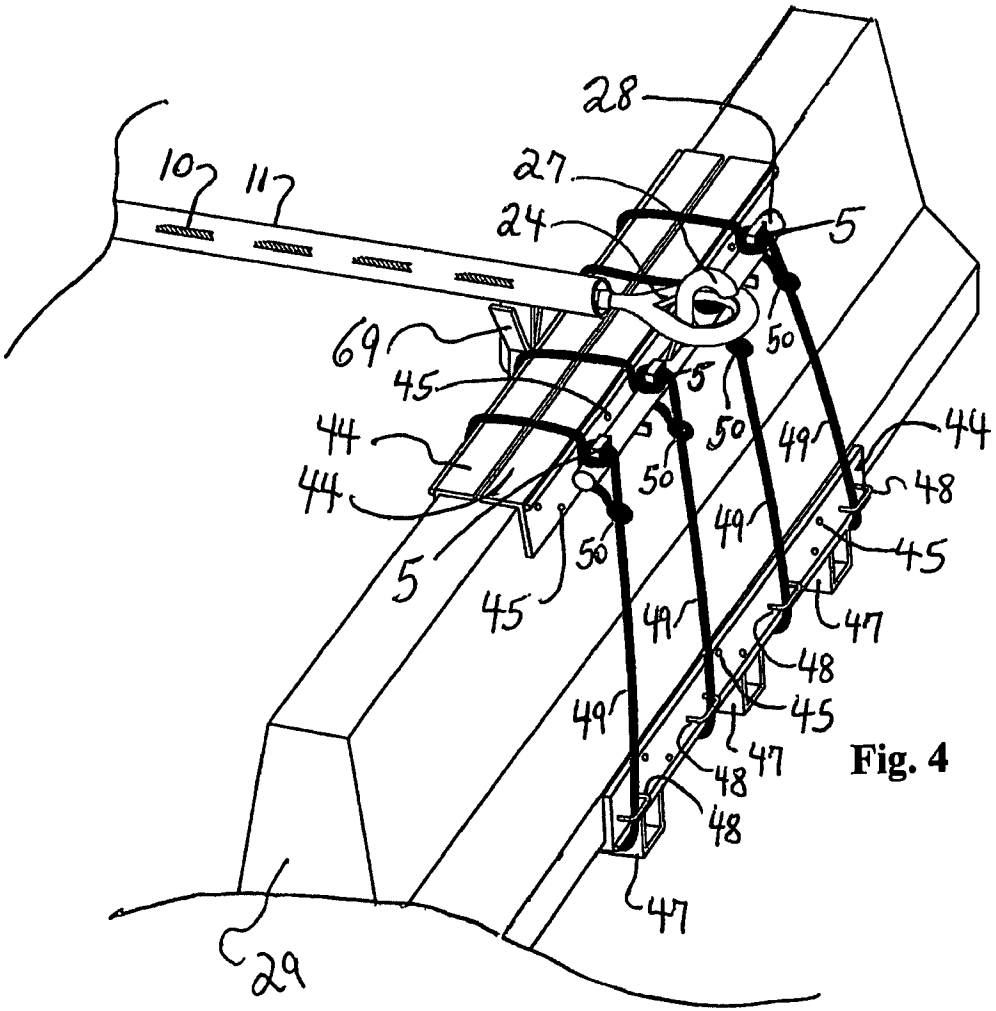
Figure 5:
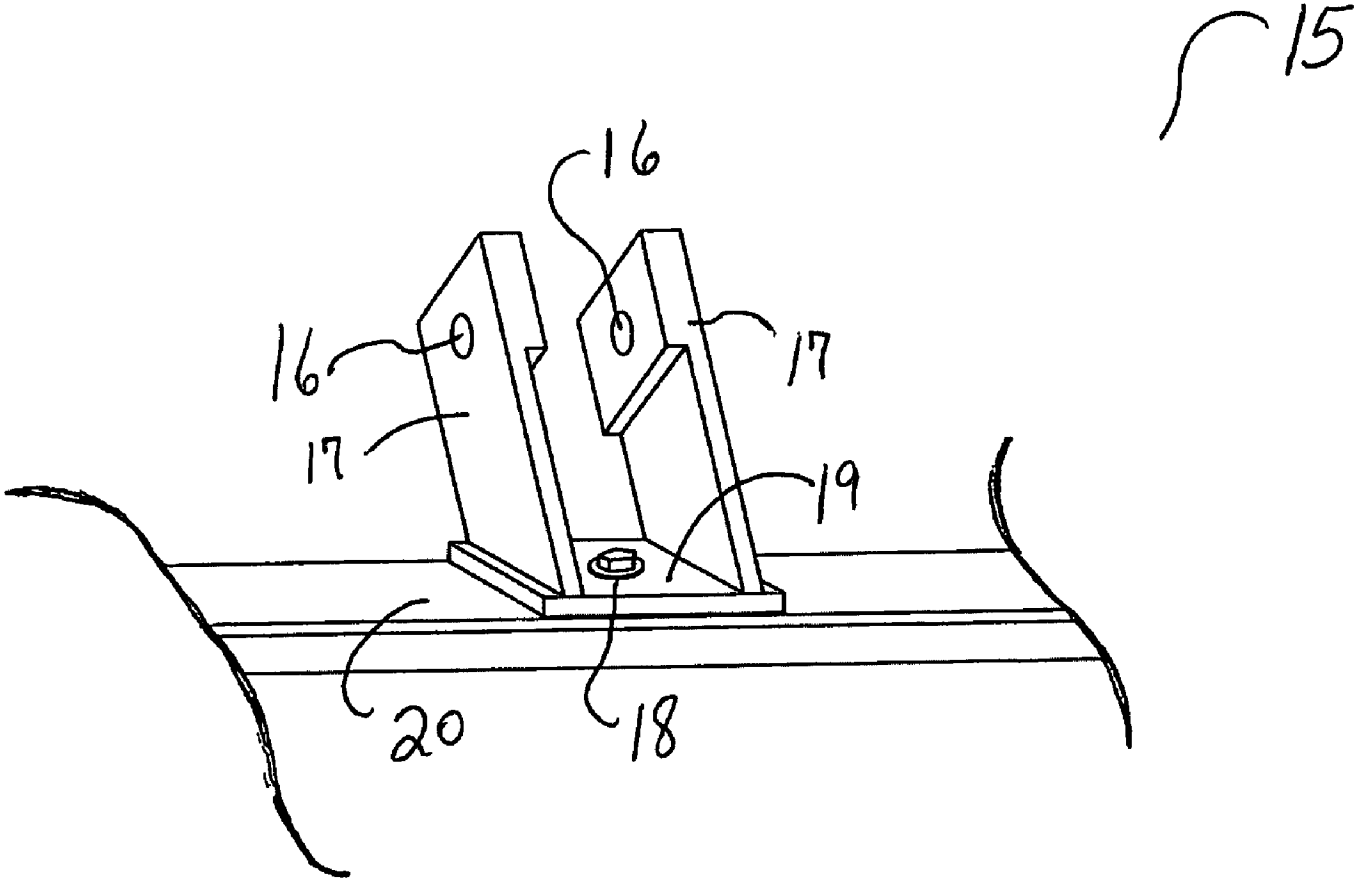
Figure 6:
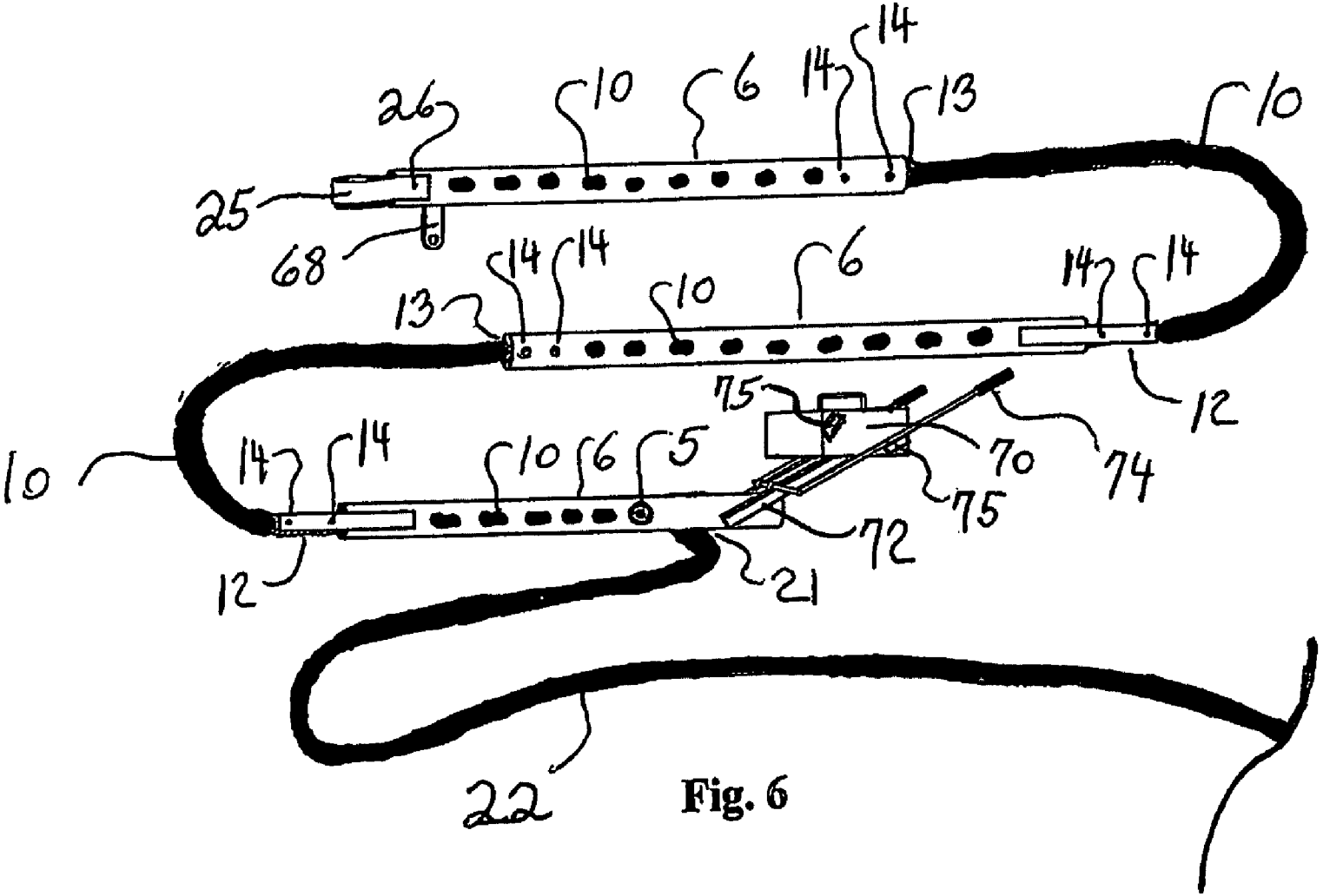
Figure 7:
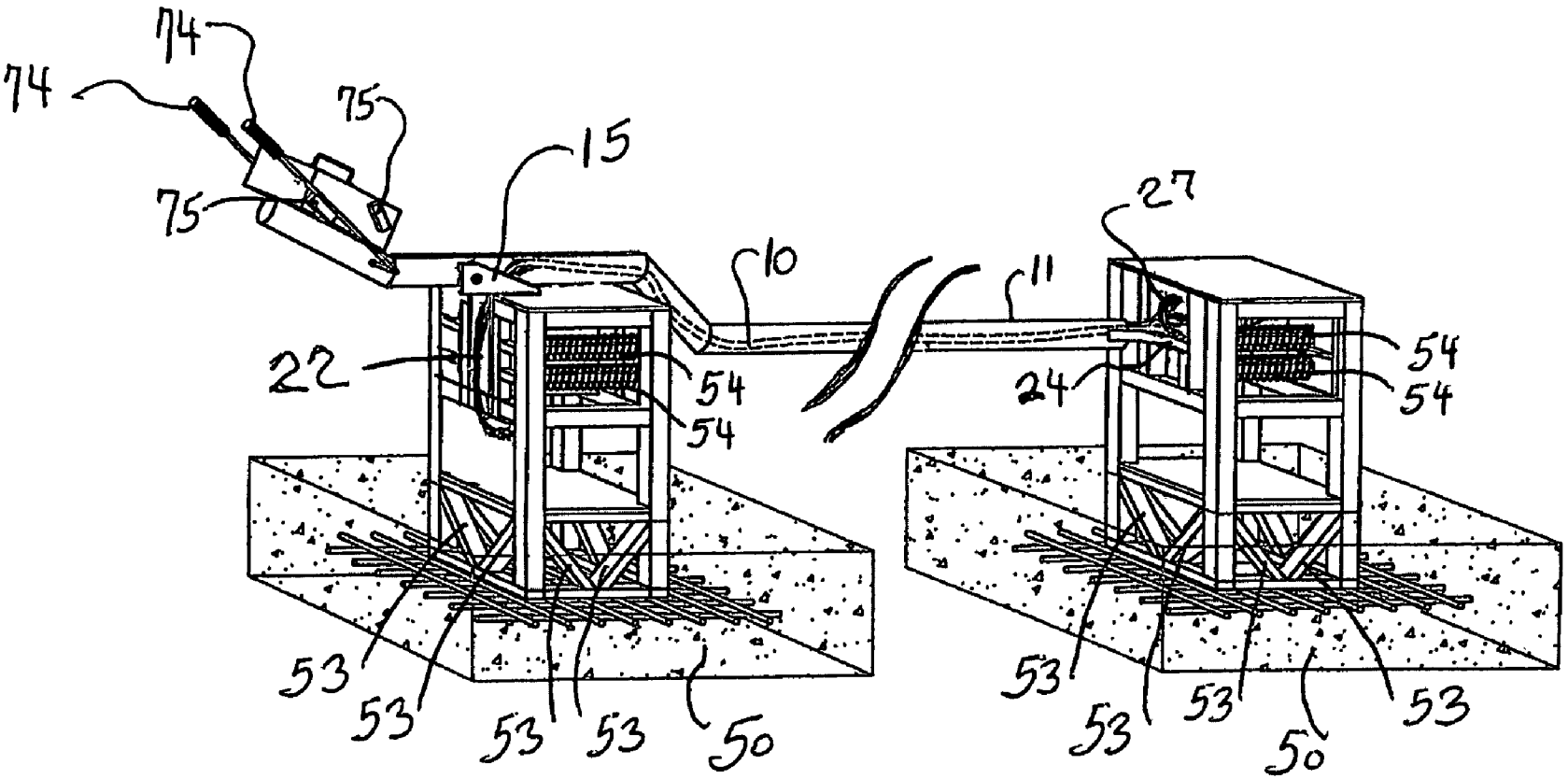
Figure 8:
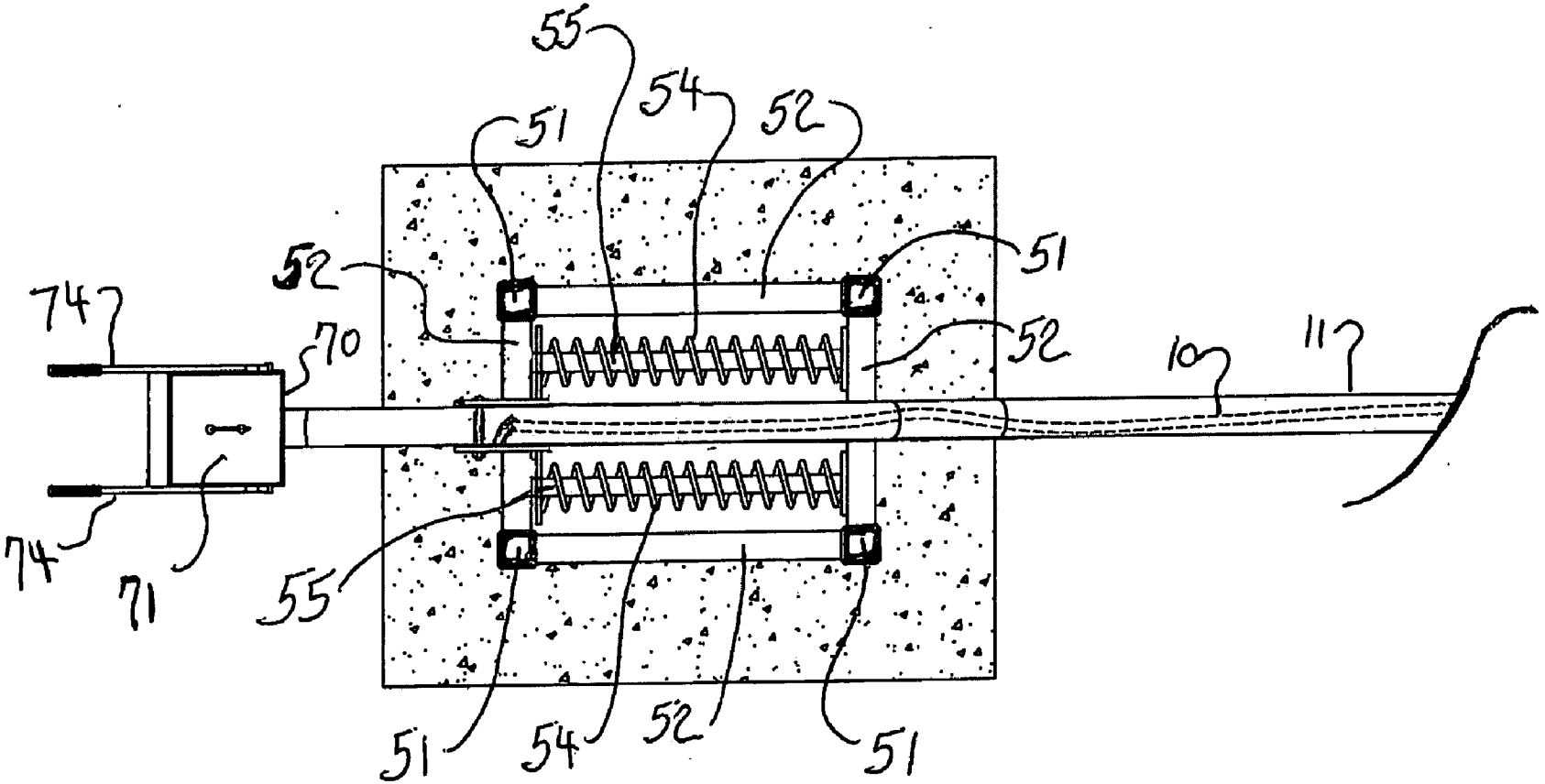

Having thus described the invention in general terms, reference will now be made to the accompanying drawings, which are not necessarily drawn to scale, and wherein:

FIG. 1 is a perspective view of one (1) non-limiting embodiment of the vehicle barrier system illustrating the longitudinal support device and cable barrier in the down position to deny vehicle passage;

FIG. 2 is a perspective view of the vehicle barrier system illustrating the longitudinal support device and cable barrier being raised vertically from a pivot point, whereas both end support structures have an additional surface weight connected;

FIG. 3 is a perspective view of the vehicle barrier system illustrating the longitudinal support device and cable barrier rotated horizontally and resting parallel to the vehicle travel path, whereas only one (1) end support structure has an additional surface weight connected;

FIG. 4 is a perspective view of the cable loop, hooking device, force equalization device, and end support components;

FIG. 5 is a perspective view of the pivot swivel device;

FIG. 6 is a perspective view of the longitudinal support device disconnected in three (3) sections with the cable barrier installed inside;

FIG. 7 is a perspective view of one (1) non-limiting embodiment of the vehicle barrier system where both end support structures are fixed in-place and contain energy absorbing compression springs;

FIG. 8 is a top view of the left side end support structure of FIG. 7.

Figure 9:
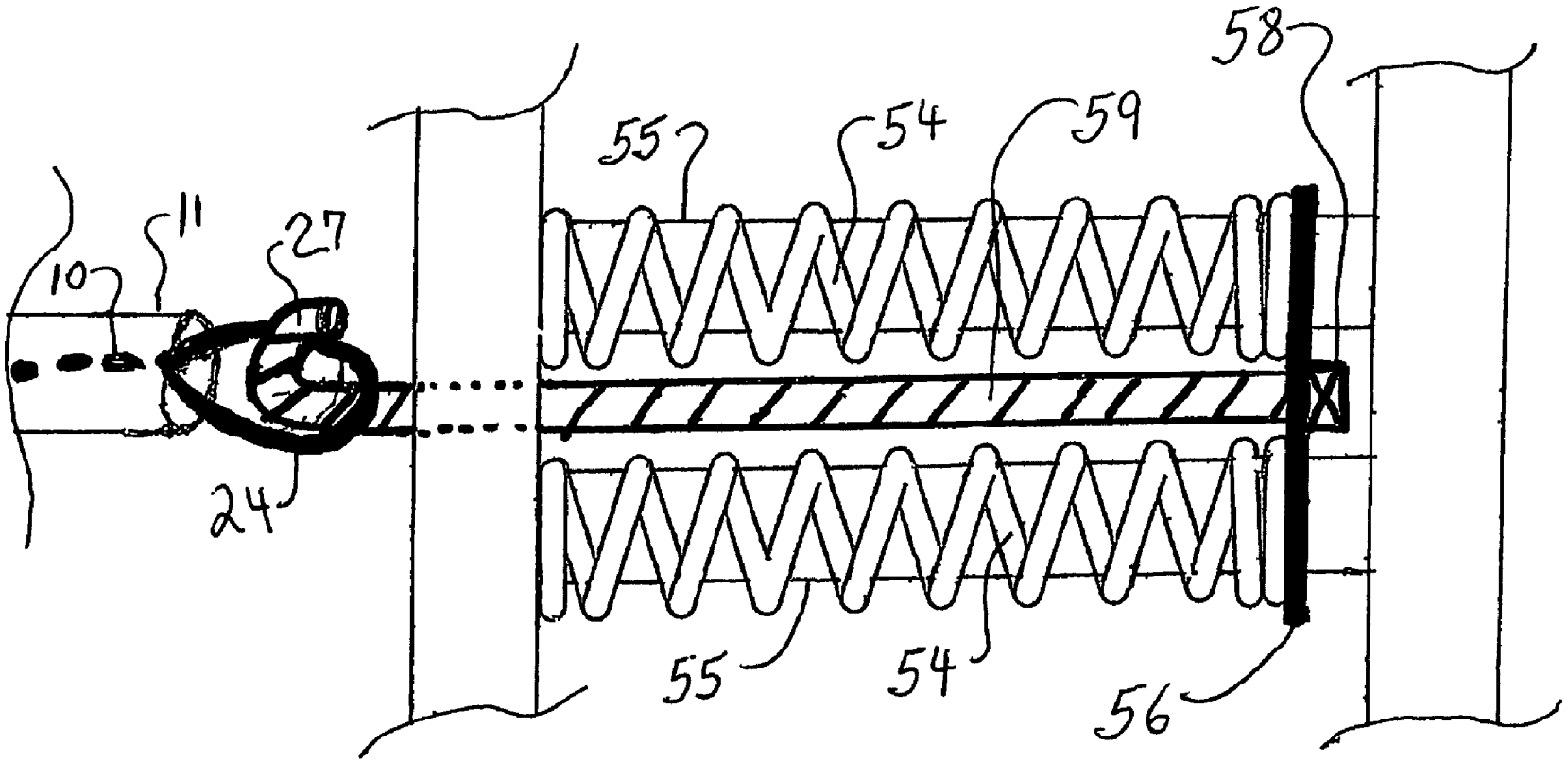
Figure 10:
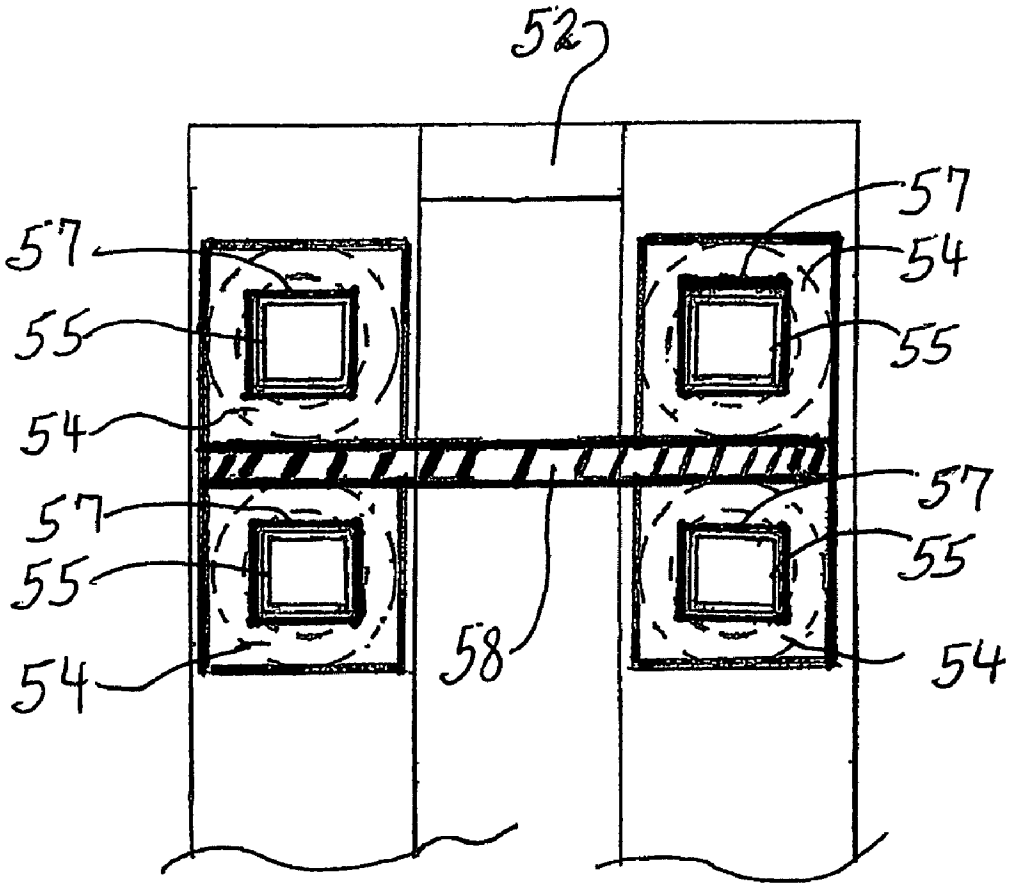
Figure 11:
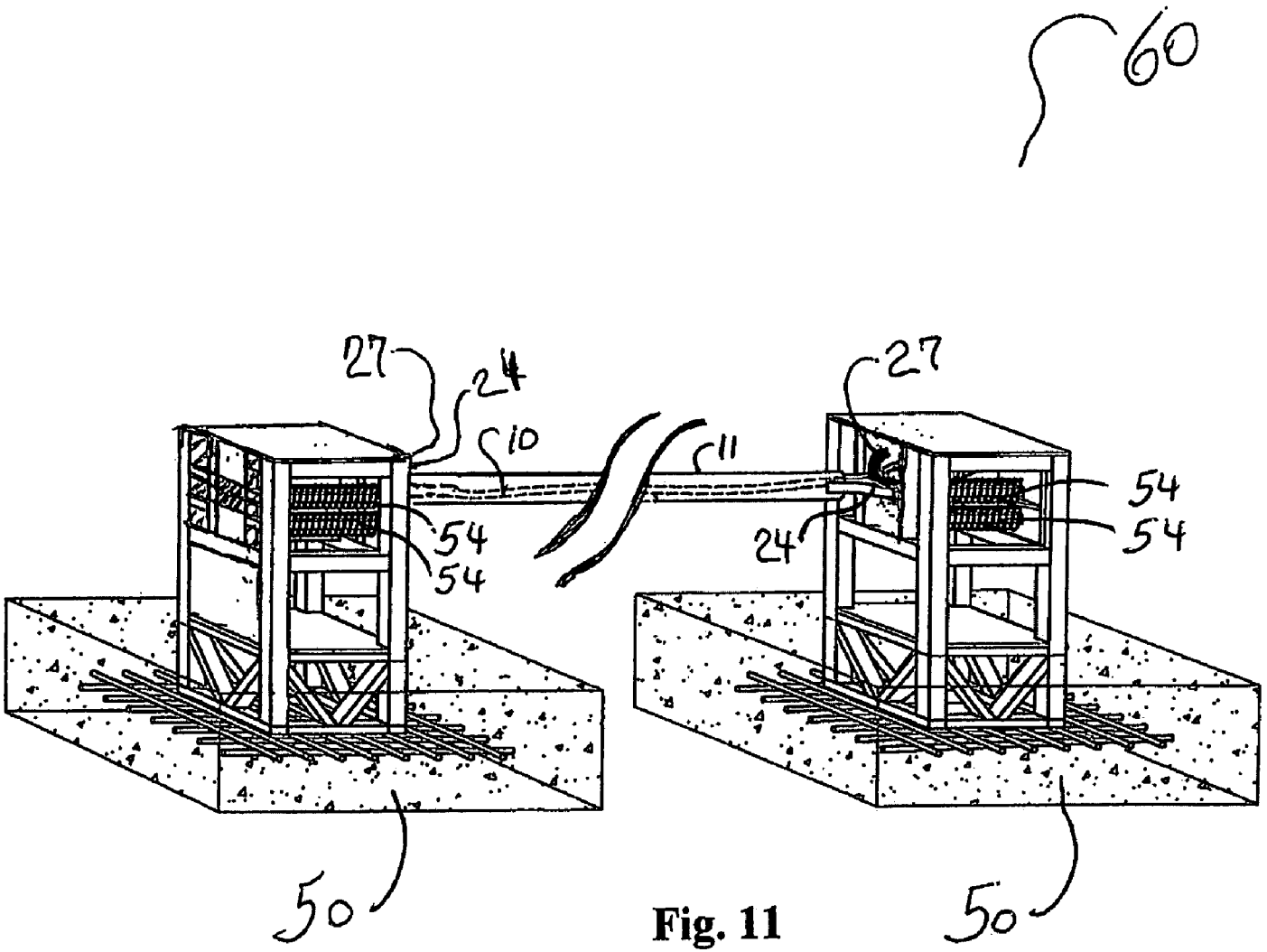
Figure 12:
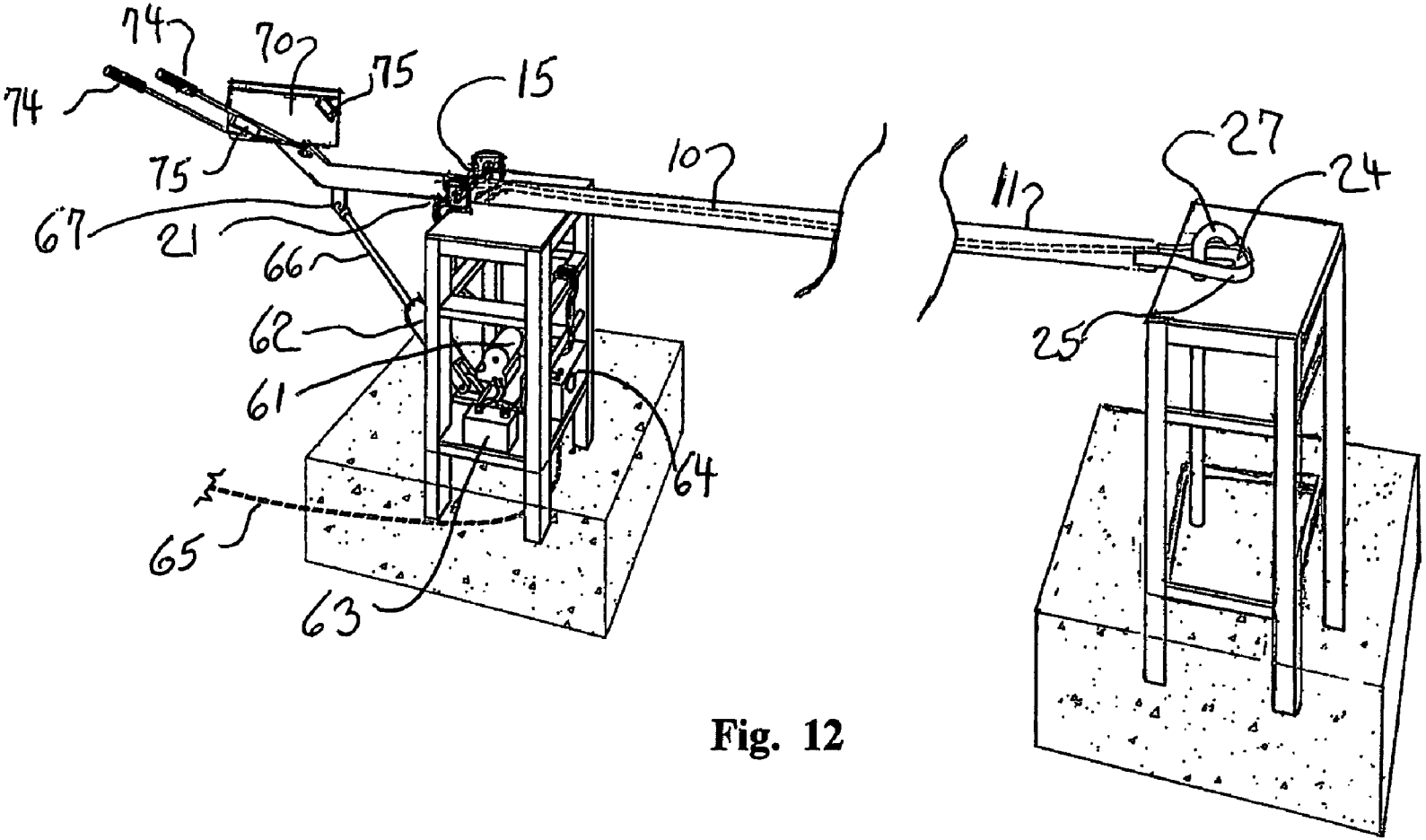

FIG. 9 is a front elevation detail of the right side end support structure of FIG. 7, illustrating the energy absorbing compression springs, hook, and cable loop;

FIG. 10 is a rear elevation detail of the right side end support of FIG. 7, illustrating the mechanisms engaging and compressing the energy absorption springs;

FIG. 11 is a perspective view of one (1) non-limiting embodiment of the vehicle barrier system in which the longitudinal support device has a cable loop detection at each end, whereas the longitudinal support device can be moved from either end support structure;

FIG. 12 is a perspective view of one (1) non-limiting embodiment of the vehicle barrier system where an electric cylinder and motor automatically raise and lower the longitudinal support device;

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements.

With reference to FIGS. 1-12, the pivot swivel cable barrier is illustrated in accordance with non-limiting embodiments of the present invention. One (1) embodiment of the pivot swivel cable barrier 7 of FIG. 1 illustrates the barrier in the down position extending across the vehicle travel path boundaries 4. The cable barrier 10 of FIG. 1 is installed inside a longitudinal support device 11. The cable barrier may be comprised of one or more continuous cable members which extend in the same longitudinal direction. The cable barrier is of high strength and light weight, and is capable of withstanding tension forces exceeding 200,000 lbs. The cable barrier is flexible, pliable, and readily bends upon impact by a vehicle. The cable barrier is resistant against abrasion. Non-limiting examples of the cable barrier include high strength synthetic fiber rope, specialty high strength straps, and steel cables. The cable barrier may be covered by a light weight durable fabric, or other flexible covering, to provide protection from ultraviolet rays, weather, and abrasion. The cable barrier remains extended longitudinally while at rest or when being moved, and remains attached to a longitudinal support device 11. Non-limiting examples of a longitudinal support device include a thin wall metal tube, high density plastic tube, a light weight thin wall solid bar, and thin wall fiber-glass bar. Cross sectional shapes of these non-limiting examples of a longitudinal support device include circular, rectangular, square, and triangular. In the non-limiting embodiments illustrated, the cable barrier is attached to the longitudinal support device and inserted through a tube, where the cable remains at least partially concealed.

One (1) embodiment of the pivot swivel cable barrier 8 of FIG. 2 illustrates the longitudinal support device being raised vertically, and another non-limiting embodiment 9 of FIG. 3 illustrates the longitudinal support device being rotated horizontally. The longitudinal support device can extend more than 24 feet in length, and may be prefabricated in multiple sections 6 of FIG. 6 with the cable 10 installed inside. In one non-limiting example, the sections are readily connected at male 12 to female 13 ends and fastened together using small diameter high strength hex bolts or pins placed through predrilled holes 14 to connect the male and female ends. The small diameter pins are inserted such that the cable is not penetrated. Prefabricated sections allow for easier packaging and shipping. When a vehicle impact occurs, the longitudinal support device bends with minimal resistance, while the cable barrier engages and resists the vehicle impact forces.

The longitudinal support device connects to a pivot swivel device 15 of FIG. 5 using a pivot pin installed through predrilled holes 16 that are reinforced on the inside with steel blocks. The predrilled holes in the longitudinal support device 5 of FIG. 6 are lined up with the predrilled holes in the pivot swivel device 16, and the pivot pin is then inserted. Non-limiting examples of pivot pins include hex bolt and nut, steel pin and clip, and steel pin with locking cap. The two (2) legs of the pivot swivel device 17 of FIG. 5 extend upward and backward at an angle, so that the pivot point is positioned behind the end support structure so that sufficient clearance is provided. A vertical pin 18 extends downward through the bottom steel plate 19 of the pivot swivel device and is fixed to the steel support 20, which is attached to the end support structure. The bottom plate of the pivot swivel device 19 rotates around the fixed steel support 20 when the longitudinal support device is rotated horizontally. The pivot swivel device also allows the longitudinal support device to pivot vertically along the axis of the pivot pin inserted through predrilled holes 16.

A cable exit hole 21 of FIG. 6 is cut into the underside of the longitudinal support device and the cable exits here. The hole is braced by metal plates on both sides so that the integrity of the longitudinal support device is not compromised. The longitudinal support device remains raised up about two inches above the end support structure to provide clearance, and allow for slack in the cable at the exit hole 21 needed for vertical or horizontal movement. The extra barrier cable length 22 is wrapped around the end support structure 30 of FIG. 1 multiple times and tied to a fixed point.

The continuous barrier cable at the other end of the longitudinal support device terminates with a cable end attachment mechanism. A non-limiting example of a cable end attachment mechanism illustrated in the attached drawings is a cable loop 24 of FIG. 4. The loop may be supported by a flexible metal strap 25 of FIG. 6 which provides rigidity to maintain the shape of the cable loop. The ends of the flexible metal strap are fixed to the longitudinal support device 26 by bolts or welding. When the longitudinal support device is moved vertically, the cable loop 24 of FIG. 4 is raised and lowered over top of a steel hook connection 27 while maintaining its shape. The cable loop is raised and lowered over top of the hook without any resistance. The cable loop passively rests around the steel hook and is not fastened or connected. There is no tension in the cable loop. If a vehicle impact occurs, the cable barrier incurs immediate tension forces and the cable loop automatically engages and connects to the steel hook.

As illustrated in the non-limiting embodiment, the steel hook is connected to a force equalization device 28 of FIG. 4, which is supported by the end support structure. During a vehicle impact, the tension forces incurred by the cable barrier are transferred to the force equalization device, which distributes the impact forces more evenly across the end support structure.

One (1) non-limiting example of an end support structure illustrated in the attached drawings are precast concrete jersey barriers 29 and 30 of FIG. 1 placed on each side of the travel path boundaries 4. End support structures may vary in type, material, sizes, and shapes. The end support structures may function to house system components, protect components from weather, support devices which electronically move the cable barrier, provide a structure to attach system components, and provide weight to resist forces incurred during a vehicle impact. Non-limiting examples of an end support structure include a precast concrete jersey barrier, steel framed structure, a truck or trailer hitch attached to a vehicle, or a hollow structure such as a plastic jersey barrier. Hollow end support structures are easily moved and then filled with water, sand or another ballast material to provide additional weight. The end support structures may be fully enclosed to protect certain components against adverse weather. End supports may be lockable and tamper proof. The end support structures remain connected to the barrier cable during a vehicle impact. In one non-limiting example, the end support structures 29 and 30 of FIG. 1 are not fixed to the subsurface and may physically move or slide when a vehicle impact occurs. The vehicle is decelerated as the end support structures are pulled by the barrier cable in the direction of the vehicle impact forces. Typically, unfixed end supports will weigh between 1000 lbs and 25,000 lbs. Additional surface weight 31 of FIG. 2 may be connected to the end support structures to increase resistance against vehicle impact forces. Additional surface weight may be connected to the end support structure using a cable 32 of FIG. 2 which is wrapped around the adjacent end support weight. A steel hook 3 of FIG. 2 is fastened to the adjacent surface weight where the cable wraps around to keep the cable in place during a vehicle impact. In one (1) non-limiting embodiment 9 of FIG. 3, only one (1) end support structure has an additional surface weight 33 of FIG. 3 attached. Here, the vehicle will be pulled toward this side where the end support weight is greater, and if the weight differential is large enough, the vehicle may be turned 45 degrees or more. Another non-limiting method to fasten additional surface weight to an end support structure is to use steel plates 34 of FIG. 3 attached using concrete wedge anchors. Cables, chains, rope, steel bars, and steel plates are non-limiting examples of devices which can be used to fasten end support structures to additional surface weights or other devices, which increase resistance against vehicle impact forces.

In one (1) non-limiting embodiment illustrated in the attached drawings, steel angle supports 44 of FIG. 4 approximately six (6) feet in length are attached to the upper and lower sides of the concrete jersey barrier end support structures 29 and 30 of FIG. 1. The steel angles are held in place using concrete wedge anchors 45 of FIG. 4. Multiple holes are pre-drilled into the steel angles, while only two (2) wedge anchors are required per steel angle. The individual multitude of steel angles provides a universal fit and can be attached to different precast concrete jersey barriers with varying heights, thicknesses, and lengths. The steel angle supports at the top may include steel welded J-hooks 46 of FIG. 2 to which cables, chain, rope, steel bars, and other devices are fastened and then connected to an additional surface weight or fixed support to increase resistance against vehicle impact forces. Steel angle supports attached to the bottom sides of the concrete jersey barrier may include cleats 47 to elevate the concrete jersey barrier approximately two (2) inches above the surface. Non-limiting examples of cleats include tubes, pipe, angles, and tees made from metal, wood, or plastics. The cleats 47 provide a space to route cables underneath an unfixed concrete end support structure, and also provide a cavity for fork lifts to lift and move the end support. U-bolts 48 are attached to the steel angle supports, and cables are routed through these U-bolts when being wrapped around the concrete end support. These U-bolts act as stays, and hold the cables at the desired spacing. At the end support structure 29 of FIG. 4 where the cable loop and hook exists, one end of the cinching cable 49 are wrapped around the concrete jersey barrier, through an eye 50 at the other end of the cinching cable, and then fixed to the force equalization device bracket 5. During a vehicle impact, the cinching cables tighten as the force equalization device is pulled. The cinching cables clamp the four steel angle supports 44 to the concrete jersey barrier, and hold the concrete end support structure together as it resists the impact forces. The steel angle supports distribute the clamping force across the concrete jersey barrier, and prevents the cables from cutting into the concrete. The weight resistance of the concrete end supports decelerates and stops the vehicle. This use of cinching cables to provide significant clamping force at an end support structure during a vehicle impact is applicable to many different embodiments of this invention. At the other end support structure 30 of FIG. 1 where the pivot point exists, the extra barrier cable exiting the hole 21 is routed through U-bolts 48, while being wrapped multiple times around the end support and then tied to a fixed point. The steel angle supports on this side also distributes the cable force across the jersey barrier, and prevents the cables form cutting into the concrete.

In another non-limiting embodiment, the end support structure remains fixed and is anchored by reinforced concrete 50 of FIG. 7. In one (1) non-limiting example, the fixed end support structure is framed using four (4) 8 inch by 8 inch vertical steel members 51 of FIG. 8. which are ½" thick and tied together laterally using 3 inch by 3 inch horizontal tubes 52 of FIG. 8. Steel tube kickers 53 are embedded in concrete and connected to vertical steel members to help prevent vertical steel members from flexing. The end support structure is anchored into a subsurface concrete foundation 50 approximately 10 feet wide by 12 feet long by 3 feet deep with steel rebar reinforcement extending in both directions and placed at 12 inches on center. Energy absorbing compression springs 54 of FIG. 9 resist tension forces in the barrier cable during a vehicle impact, while compressing and absorbing energy. Compression springs may be comprised of steel or titanium to list non-limiting examples. In one (1) non-limiting example, the compression springs are three (3) foot long and 12 inches in diameter. A horizontal steel spring support tube 55 of FIG. 9. extends longitudinally inside each compression spring to allow the spring to freely compress while supporting it. The spring support tubes 55 are attach to the end support structure. A steel plate 56 is placed at the rear of the compression springs. A cut out in the steel plate 57 of FIG. 10 equal to the perimeter of the spring support tube allows the steel plate 56 to slide along the spring support tube when the springs are compressed. A solid steel 4 inch by 4 inch steel bar 58 of FIG. 10 bears against the rear of the steel plates, and is welded solid to the horizontal section of the steel cable hook 59 of FIG. 9. Upon vehicle impact, the barrier cable loop 24 engages and connects to the steel hook 27 which pulls the springs into compression. On the other side of the vehicle travel path, the extra barrier cable 22 of FIG. 7 wraps around the end support structure and connects to a solid steel bar at the front end the end support structure which pulls the springs into compression upon impact. Significant kinetic energy is absorbed when the springs are compressed, and the vehicle is decelerated. Once fully compressed, the steel springs bear against the end support structure. The remaining cable tension force from the vehicle impact is instantly absorbed by the end support structures and transferred into the earth. The energy absorbing compression springs compress in a linear direction without rotating, and automatically extend back out of compression after the vehicle's forward momentum stops. The vehicle is typically pulled backward as the springs extend back out of compression.

In another non-limiting embodiment 60 of FIG. 11, the longitudinal support device 11 is comprised of cable loops 24 on both sides. The cable loops rest passively around the steel hooks 27 at both end support structures. There is no tension in the cable and it remains unfastened to the end support. If a vehicle impact occurs, both cable loops engage against the steel hooks, which pull the compression springs and absorb kinetic energy, and the cable ultimately stops the vehicle. The longitudinal support device with the embedded cable barrier is light weight and may be manually moved by raising or lowering it vertically, pivoting it horizontally, or completely removing it from across the vehicle travel path.

In another non-limiting embodiment, the longitudinal support device 11 of FIG. 12 is automatically moved using an electric motor 61 and cylinder 62. The cylinder is powered by 12 volt DC batteries 63, and the batteries are charged automatically by a smart charger 64 which is powered by a 120 volt ac power supply 65 from offsite. During a power outage, the fully charged batteries provide several movement cycles without re-charge. The electric cylinder is connected at the bottom of the end support structure using a pivoting pin connection so that the cylinder can rotate while extending and retracting. The cylinder rod 66 is connected to the bottom of the longitudinal support device using a pivoting connection 67. The cylinder is sized so that while the cylinder rod 66 is fully extended, the longitudinal support device is horizontal, and when the rod is retracted, the longitudinal support device is vertical. A hydraulic system comprised of a pump, motor, hydraulic accumulator, valves, reservoir and other hydraulic components may also be used to move the longitudinal support device automatically in the vertical or horizontal directions. Control devices which may include keypads, wireless controllers, or card readers to list some non-limiting examples, may be used to activate and operate the automated movements. The automated system is easily disconnected to immediately allow for manual operations.

A guide fin 68 of FIG. 2 approximately two (2) inches wide by four (4) inches long is attached to the underside of the longitudinal support device. When the longitudinal support device is lowered, the guide fin 68 slides between guide fin brackets 69 attached to the steel angle support. The guide fin bracket is wider at the top and becomes narrower as the guide fin enters further into the bracket. This guide fin mechanism ensures that the longitudinal support device is lowered into the correct position, so that the cable loop is overtop of the steel hook 27 of FIG. 4. The cable loop 24 of FIG. 4 has no tension and remains unattached to the steel hook while at rest. It is readily raised over top of the hook without resistance. The cable loop 24 engages and attaches to the steel hook 27 only if a vehicle impact occurs. While the longitudinal support device is at rest in the down position to deny vehicle passage, it may be locked in-place by inserting a pad lock through pre-drilled holes the guide fin 68 and guide fin bracket 69 which line up.

The longitudinal support device is moved manually by one (1) person. Typically, the longitudinal support device is painted yellow and wrapped with red reflective tape to increase visibility. A counterweight mechanism 70 of FIG. 6 is attached at the end of the longitudinal support device. The counterweight mechanism is approximately 12 inches by 12 inches by 8 inches tall and has a removable lid 71 of FIG. 8 where counterweight blocks can be added or removed to achieve the balancing weight desired. Non-limiting examples of counterweight blocks include lead bricks, solid steel bar, sand, concrete, or steel plates to list some examples. Counterweight blocks are added or removed so that moment forces on each side of the pivot point are near balance, and the longitudinal support device falls slowly toward the down position. At the end of the longitudinal support device on the pivot side, an extension attaches to the longitudinal support device and protrudes at an angle 72 of FIG. 6, and is connected to the counterweight device. This extension protruding at an angle allows the longitudinal support device to be raised so that it is vertical, without the counterweight device hitting the back of the end support structure or the ground. Furthermore, the counterweight device attached at this angle reduces the amount of lifting force required by the operator performing manual movements. Rotating handles 74 of FIG. 6 on each side of the counterweight device provide leverage so that the manual operator can raise and lower the longitudinal support device with less force. The handles will pivot up about one (1) foot or pivot downward about (1) foot before catching steel blocks 75 of FIG. 7 welded onto each side of the counterweight box. This range in movement where the handles rotate up or down before becoming fixed against the steel blocks provides both increased leverage and improved lifting angles, making the longitudinal support device easier to manually move. A pivot swivel connection allows the operator to rotate the longitudinal support device 11 of FIG. 3 horizontally, where it rests generally parallel to the vehicle travel path boundaries 4. The longitudinal support device can be rotated in either horizontal direction. This horizontal swiveling capability is critical when trucks must pass through the vehicle travel path while carrying loads that extend beyond the width of the truck bed, where a vertically raised support arm may obstruct passage.

The vehicle barrier system can be operated manually from either end support structure or from either side of the vehicle travel path. Manual operations from the end support structure located where the cable end loop exits, involves pushing up the longitudinal support device, until it begins to raise up on its own from the counterweight force acting on the other side of the pivot point. Here the operator holds a string line 76 of FIG. 2 attached to the guide fin 68 while raising the longitudinal support device, and pulls on the string to lower it back into place. The string line 76 of FIG. 3 can be wrapped around the longitudinal support device when not in use. An operator can manually move the longitudinal support device horizontally in either direction by walking with it. Manual movement is also capable from the other end support structure on the other side of the vehicle travel path, and involves using the rotating handles 74 to pivot and raise the cable barrier vertically or swivel and rotate it horizontally. The ability to manually operate the barrier from either side of the travel path, and raise it vertically or rotate it horizontally in either direction is advantageous.

The pivot swivel cable barrier may be comprised of modular, prefabricated components capable of attaching to many different types of end support structures. The modular components are easily packaged and shipped, and readily assembled at an offsite location using basic tools. Non-limiting embodiments where unfixed end support structures rest on the surface, can be readily relocated and operational without requiring disassembly and assembly. Embodiments of end support structures may include an enclosure with locking doors, which limits internal access to select persons and protects components from adverse weather.

Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A portable barrier system for allowing or denying vehicle passage through first and second end support structures, wherein the portable barrier system is adapted to receive a vehicle impact to deny passage, the portable barrier system comprising:

a longitudinal support device having a first end pivotally connected to the first end support structure;

a cable barrier supported by said longitudinal support device to stop an oncoming vehicle, wherein said cable barrier defines a loop that projects from an end of said cable barrier;

a force equalization device connected to the second end support structure;

a curved member extending from said force equalization device and fitting entirely through a perimeter of said loop defined by said cable barrier, said curved member defining an open hook projecting from said force equalization device, wherein said curved member is in a fixed position relative to the second end support structure and maintains the fixed position before, during, and after a vehicle impacts said cable barrier;

a cinching cable defining an eye at one end of said cinching cable, said cinching cable wrapping around said second end support structure, passing back through said eye, and connecting to said force equalization device such that said cinching cable tightens entirely around said second end support structure during a vehicle impact on said cable barrier.

2. The portable barrier system of claim 1, wherein said open hook projects from said force equalization device in a substantially vertical, fixed position in relation to the second end support structure.

3. The portable barrier system of claim 2, wherein said open hook curves downwardly toward the second end support structure.

4. The portable barrier system of claim 3, wherein prior to vehicle impact, said loop defined by said cable barrier encircles said curved member without engaging said curved member, and upon vehicle impact, said loop of said cable barrier engages said open hook to allow said cable barrier to maintain an attachment to the second end support structure.

5. The portable barrier system of claim 1, wherein said cable barrier wraps around the first end support structure at least once and extends through the longitudinal support device.

6. The portable barrier system of claim 1 wherein said longitudinal support device is connected to the first end support structure by a pivot swivel device.

7. The portable barrier system of claim 1 further comprising a counterweight attached to the first end of the longitudinal support structure.

8. The portable barrier system of claim 1 wherein the longitudinal support structure at least partially encloses the cable barrier.

9. A portable barrier system according to claim 1 further comprising at least one angle support configured for mounting on a top or bottom portion of either the first or second end support structure.

10. A portable barrier system according to claim 1, further comprising:

a support mounted under the second end support structure.

11. A portable barrier system according to claim 1, comprising:

a support mounted under the first end support structure;

wherein said cable barrier wraps around the first end support structure at least once and engages the support mounted under the first end support structure.

12. The portable barrier system of claim 1 further comprising at least one cleat for elevating at least one of the first and second end support structures above the ground.

13. The portable barrier system of claim 1, further comprising an electric motor that automatically drives the longitudinal support device.

14. The portable barrier system of claim 1, wherein said longitudinal support device comprises multiple sections.

15. The portable barrier system of claim 1, wherein said loop is a substantially circular loop formed by one end of said cable barrier.

16. The portable barrier system of claim 1 wherein before, during, and after vehicle impact, at least one end of said cable barrier is fixed in a stationary position to an end support.

17. A portable barrier system according to claim 1, wherein said cinching cable is tied into a knot around said force equalization device.

18. A portable barrier system for allowing or denying vehicle passage through first and second end support structures, wherein the portable barrier system is adapted to receive a vehicle impact to deny passage, the portable barrier system comprising:

a longitudinal support device having a first end pivotally connected to the first end support structure;

a cable barrier supported by said longitudinal support device to stop an oncoming vehicle, wherein said cable barrier defines a loop that projects from an end of said cable barrier;

a force equalization device connected to the second end support structure;

an open hook projecting from said force equalization device without engaging the remainder of the portable barrier system, said open hook fitting within said loop and maintaining a fixed position before, during, and after a vehicle impacts said cable barrier; and a cinching cable defining an eye at one end of said cinching cable, said cinching cable connected to said force equalization device, wrapping around said second end support structure, and passing back through said eye such that said cinching cable tightens entirely around said second end support structure during a vehicle impact on said cable barrier.

19. A portable barrier system according to claim 18, wherein said cinching cable is tied into a knot around said force equalization device.

20. A portable barrier system for allowing or denying vehicle passage through first and second end support structures, wherein the portable barrier system is adapted to receive a vehicle impact to deny passage, the portable barrier system comprising:

a longitudinal support device having a first end pivotally connected to the first end support structure;

a cable barrier supported by said longitudinal support device to stop an oncoming vehicle, wherein said cable barrier defines a loop that projects from an end of said cable barrier;

a force equalization device connected to the second end support structure;

an open hook projecting from said force equalization device in a fixed position relative to the second end support structure, said open hook maintaining the fixed position before, during, and after a vehicle impacts said cable barrier, wherein the system comprises a down position for said cable barrier in which said loop fits over said open hook; and a cinching cable defining an eye at one end of said cinching cable, said cinching cable connected to said force equalization device, wrapping around said second end support structure, and passing back through said eye such that said cinching cable tightens entirely around said second end support structure during a vehicle impact on said cable barrier.

21. A portable barrier system according to claim 20, further comprising a support mounted under said second end support structure, wherein said cinching cable attaches to said support and increases a force of compression about the second end support structure during a vehicle impact.

22. A portable barrier system according to claim 20, wherein prior to vehicle impact, said loop rests passively around said open hook without engaging said open hook.

23. A portable barrier system according to claim 20, wherein said open hook curves downwardly toward the second end support structure.

24. A portable barrier system according to claim 20, wherein said open hook is in a substantially vertical, fixed position in relation to the second end support structure without engaging said second end support structure or the remainder of the portable barrier system.

25. A portable barrier system according to claim 20, wherein said cinching cable is tied into a knot around said force equalization device.

26. A portable barrier system for allowing or denying vehicle passage through first and second end support structures, wherein the portable barrier system is adapted to receive a vehicle impact to deny passage, the portable barrier system comprising:

a longitudinal support device having a first end pivotally connected to the first end support structure;

a cable barrier supported by said longitudinal support device to stop an oncoming vehicle, wherein said cable barrier defines a loop that projects from an end of said cable barrier;

an open hook projecting from the second end support structure in a fixed position relative to the second end support structure, said open hook maintaining the fixed position before, during, and after a vehicle impacts said cable barrier; and a cinching cable defining an eye at one end of said cinching cable and connected to said open hook at an opposite end of said cinching cable, said cinching cable wrapping around said second end support structure and passing back through said eye, and connecting to said open hook such that said cinching cable tightens entirely around said second end support structure during a vehicle impact on said cable barrier.

* * * * *